US006360373B1

(12) United States Patent
Rehn et al.

(10) Patent No.: US 6,360,373 B1
(45) Date of Patent: Mar. 26, 2002

(54) GLOVE WITH REMOVABLE OUTER LAYER

(75) Inventors: Richard Rehn; Martin H. G. Deeg, both of Ritzville, WA (US)

(73) Assignee: LL Safety West, Ritzville, WA (US)

( * ) Notice: Subject to any disclaimer, the term of this patent is extended or adjusted under 35 U.S.C. 154(b) by 0 days.

(21) Appl. No.: 09/537,987

(22) Filed: Mar. 29, 2000

(51) Int. Cl.[7] ..... A41D 19/00
(52) U.S. Cl. ..... 2/161.6; 2/169; 15/227
(58) Field of Search ..... 2/16, 20, 159, 2/160, 161.7, 161.8, 164, 167, 168, 169; 15/227

(56) References Cited

U.S. PATENT DOCUMENTS

| | | | | | |
|---|---|---|---|---|---|
| 3,608,708 | A | * | 9/1971 | Storandt | 206/46 |
| 3,870,150 | A | | 3/1975 | Hummel | |
| 4,002,276 | A | | 1/1977 | Poncy et al. | |
| 4,069,913 | A | | 1/1978 | Harrigan | |
| 4,660,228 | A | | 4/1987 | Ogawa et al. | |
| 4,696,065 | A | * | 9/1987 | Elenteny | 2/168 |
| 4,847,918 | A | * | 7/1989 | Sturm | 2/161 |
| 4,915,226 | A | | 4/1990 | Keenan | |
| 5,317,759 | A | | 6/1994 | Pierce | |
| 5,486,322 | A | * | 1/1996 | Fuchs | 264/46.5 |
| 5,566,405 | A | | 10/1996 | Masley | |
| 5,636,382 | A | | 6/1997 | Chopko et al. | |
| 5,822,791 | A | | 10/1998 | Baris | |
| 6,024,970 | A | * | 2/2000 | Woodard | 424/402 |
| 6,145,155 | A | * | 11/2000 | James et al. | 15/227 |

FOREIGN PATENT DOCUMENTS

| | | | | |
|---|---|---|---|---|
| GB | 2164540 | * | 3/1986 | 2/161.6 |
| GB | 221865 | * | 5/1987 | 2/161.6 |
| GB | 526003 | * | 3/1993 | 2/161.6 |

* cited by examiner

*Primary Examiner*—Bibhu Mohanty
*Assistant Examiner*—Katherine Moran
(74) *Attorney, Agent, or Firm*—Watts, Hoffmann, Fisher & Heinke Co. LPA

(57) ABSTRACT

A protective glove having removable outer layers comprises an substantially contaminant free inner glove having at least one outer layer and a method of use thereof. The outer layer has a shape of the glove and is frangibly fused to a selected side of the inner glove. The outer layer material has a lower melt temperature than the inner glove material and can be easily peeled from the inner glove immediately prior to a use requiring the glove to be substantially contaminant free. Also included are methods for making the protective glove.

12 Claims, 4 Drawing Sheets

GLOVE WITH REMOVABLE OUTER LAYER

FIELD OF INVENTION

The present invention relates generally to protective gloves. More particularly, the invention relates to a protective glove having an inner glove with removable outer layers and a method of use and manufacture thereof.

BACKGROUND OF THE INVENTION

Manufacture of pharmaceuticals, electronics, optical parts and the like generally require use of protective gloves for certain steps of each respective process. Likewise, the use of protective gloves have commonly been used in settings where the hand is likely to be soiled, contaminated or cause soiling or contamination to an object to be handled, such as the health care industry, cosmetic industry and the like. The protective gloves serve to protect the user from the object handled and the handled object from the user. For instance; in the manufacture of electronic circuit assemblies, any ionic contamination or particles can deleteriously affect final device performance. Thus, the use of protective gloves can prevent both contact by a user's hands which are known sources of particle contamination and contamination from materials generated by the glove. In the health care industry, protective gloves are worn by health care staff to prevent bacterial contamination to and from the patient, thereby preventing a source of infection.

The typical protective glove is a stand alone glove and is used by donning the glove on the user's hands. The gloves are typically made of nonpyrogenic flexible materials such as, rubber, vinyl, latex or the like and provide a barrier between the hand and the object to be handled. The gloves are generally sold as loose individual gloves, or as sterile, prepackaged gloves prepared in a clean environment in multiple clean bags. One problem with these gloves is that the user is typically faced with changing environments requiring frequent changing of the gloves. For example, clean, contaminant free gloves used in the pharmaceutical, optic, electronics and other industries are worn in clean, controlled environments. To prevent contamination of this environment, workers don protective clothing including, among others, clean contaminant free, protective gloves. To maintain maximum cleanliness in the controlled environment and thus product integrity, workers periodically change these gloves on a set schedule or whenever the work environment dictates the use of clean, contaminant free gloves. Under normal conditions, a health care worker must don a new pair of gloves that are sterile and substantially contaminant free to attend to a patient's wounds. The worker cannot use the same gloves he/she might have used earlier for other purposes, such as emptying a bedpan. It would be desirable to the health care worker to be able to use one pair of gloves for general work in a patients room wherein a glove with a protective barrier is all that is needed. It is further desirable for that same pair of gloves to be easily adapted for use in attending to a patients wounds, if needed, wherein the glove is substantially free from contaminants, thus eliminating the frequent changing of gloves for different uses.

Accordingly, there is a need for a novel and improved protective glove that offers a higher level of cleanliness or purity, is easy to don, can be all- purposely used and if, or when required, easily adapted for use as a substantially contaminant free glove suitable for use in clean work environments. Since the gloves are generally used once and then discarded, the gloves must be relatively inexpensive to manufacture.

SUMMARY OF THE INVENTION

The present invention is directed to a protective glove comprised of an inner glove with removable outer layers. Advantageously, the inventive protective glove can be worn and used with the outer layers removed or intact. Upon removing the outer layers, the inner glove surface is substantially contaminant free and can be used in conditions that require a clean work environment without being a source of contamination to the user or the object handled.

The removable outer protective layers are frangibly fused to selected sides of the inner glove. Each outer glove layer is comprised of a nonpyrogenic material having a lower melt temperature than the inner glove material allowing the outer glove layers to be easily removed. Preferably, the outer glove layer is made from a polyolefin. The inner glove is comprised of a nonpyrogenic material with elastomeric characteristics and has a higher melt temperature than the outer glove layer material. Preferably, the inner glove is water vapor permeable for improved wearer comfort. Preferably, the inner glove is comprised of a selected one of a polyurethane, polyolefin, polyester, polyacrylate, polytetrafluoroethylene, or a blend or copolymer thereof containing in part these materials. Other materials suitable for use in the present invention will be apparent to one skilled in the art in view of this disclosure. The protective glove according to the present invention allows a user to peel away the outer layer to expose a substantially contaminant free inner glove for use in environments or with objects that require the glove to be a substantially contaminant free barrier.

The present invention advantageously allows the user to don the protective gloves and use them accordingly in an external environment that requires the user's hands to be protected. Thus, the glove can be used in environments and in a manner consistent with its use as a protective covering for the user's hands. If the object to be handled or the external environment conditions require the user to minimize contamination, the user can easily remove the outer layers to expose the inner glove having an external surface substantially free from contamination at a time most convenient to the user. Thus, when protection of the work environment is required, the wearer simply removes the protective layer to expose the clean, contaminant free glove.

In one embodiment, a process of securing easily peeled outer glove layers to the clean room glove for easy discard just before entering a clean room environment comprises the steps of cutting a hand shape pattern into a first film and a second film. The second film has a lower melt temperature that said first film. A stack is arranged comprising two layers of the hand shaped first film interspersed between two layers of the hand shaped second film. The layers are sealed forming the protective glove having the inner glove and removable outer layers.

In another embodiment, a process of securing an easily peeled outer glove layers to the clean room glove for easy discard just before entering a clean room environment comprises the steps of providing a hand shaped mold. The mold is dipped into a body of a first liquid material. The mold is withdrawn when a first layer of the first material has become adhered. Once the first layer is dried, the mold is dipped into a body of a second liquid material wherein the second material has a lower melting point than the first material. The mold is withdrawn once a second layer of the second material has become adhered to the first layer. The second layer is then dried forming removable outer layers. The materials are removed from the mold forming the protective glove having an inner glove and removable outer layers.

In another embodiment, an elastomeric glove material is extruded onto an inert polymeric material. Two parts of this multilayer film are placed on top of each other with the inert polymeric material forming the outer layers. A heated hand shaped pattern is simultaneously cut out of the so formed sandwich and the inner glove edges are sealed forming the multilayer glove with removable layers.

Other embodiments of the invention are contemplated to provide particular features and structural variants of the basic elements. The specific embodiments referred to as well as possible variations and the various features and advantages of the invention will become better understood from the accompanying drawings together with the detailed description that follows.

DETAILED DESCRIPTION OF THE PREFERRED EMBODIMENTS

The protective glove according to the present invention comprises a contaminant free inner glove having easily removable outer layers. The protective glove protects a user's hands and acts as a barrier between the hand and an object to be handled or an external environment. The outer layers of the protective glove prevent contamination to the inner glove by the objects handled or the external environment and allow the user to remove the outer layer in situations that require the inner glove to be substantially free from contamination. Thus, the user can don the protective gloves, use the gloves accordingly and remove the outer layer at a time where the external conditions indicate the use of contaminant free protective gloves. The inventive glove permits the user to easily discard the outer layer immediately prior to use in those external conditions and results in a substantially contaminant free inner glove suitable for use in clean work environments. The protective glove is made from flexible materials having low contaminants, low impurities, and is generally impervious to water.

Figure 1:
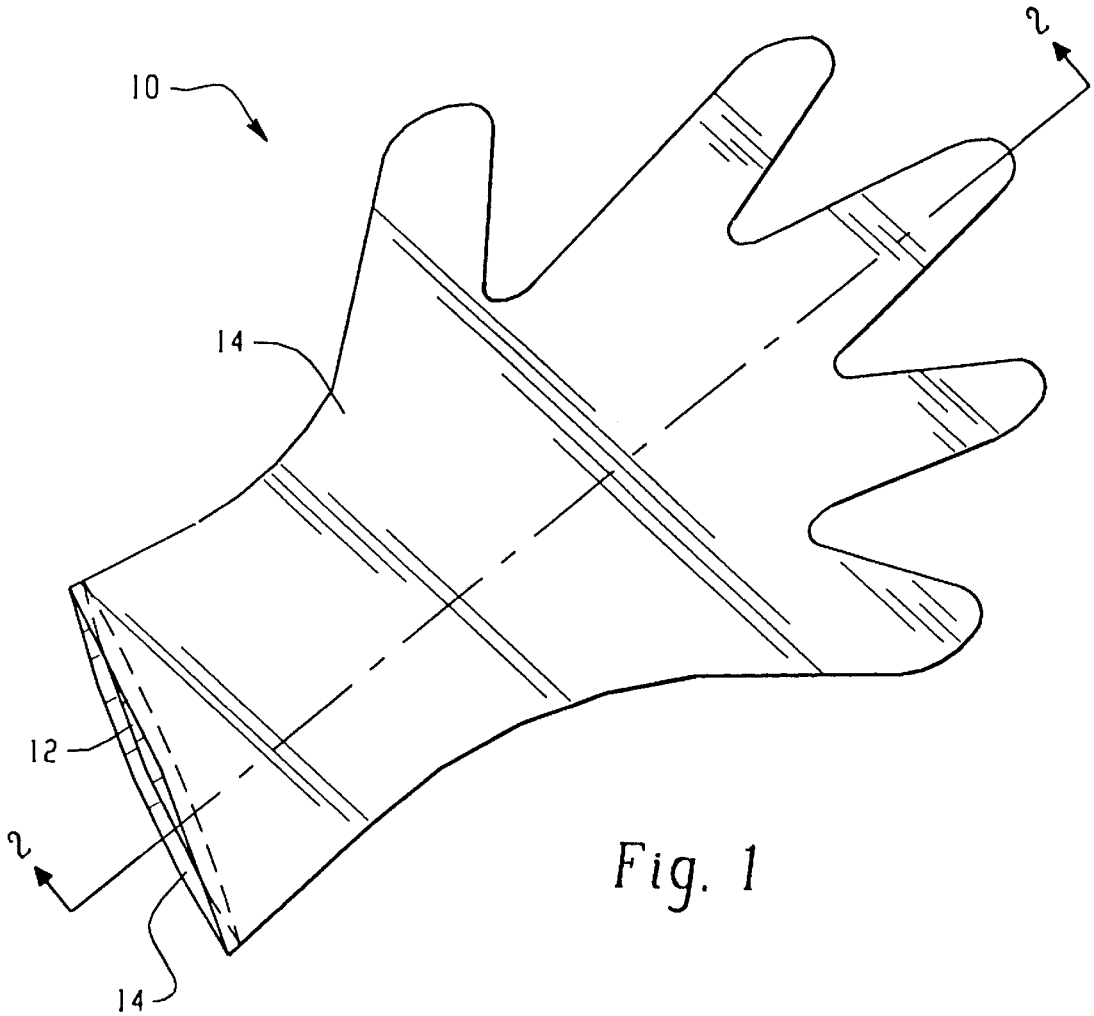
FIG. 1 is a top perspective view of a protective glove in accordance with the invention.
Figure 3:
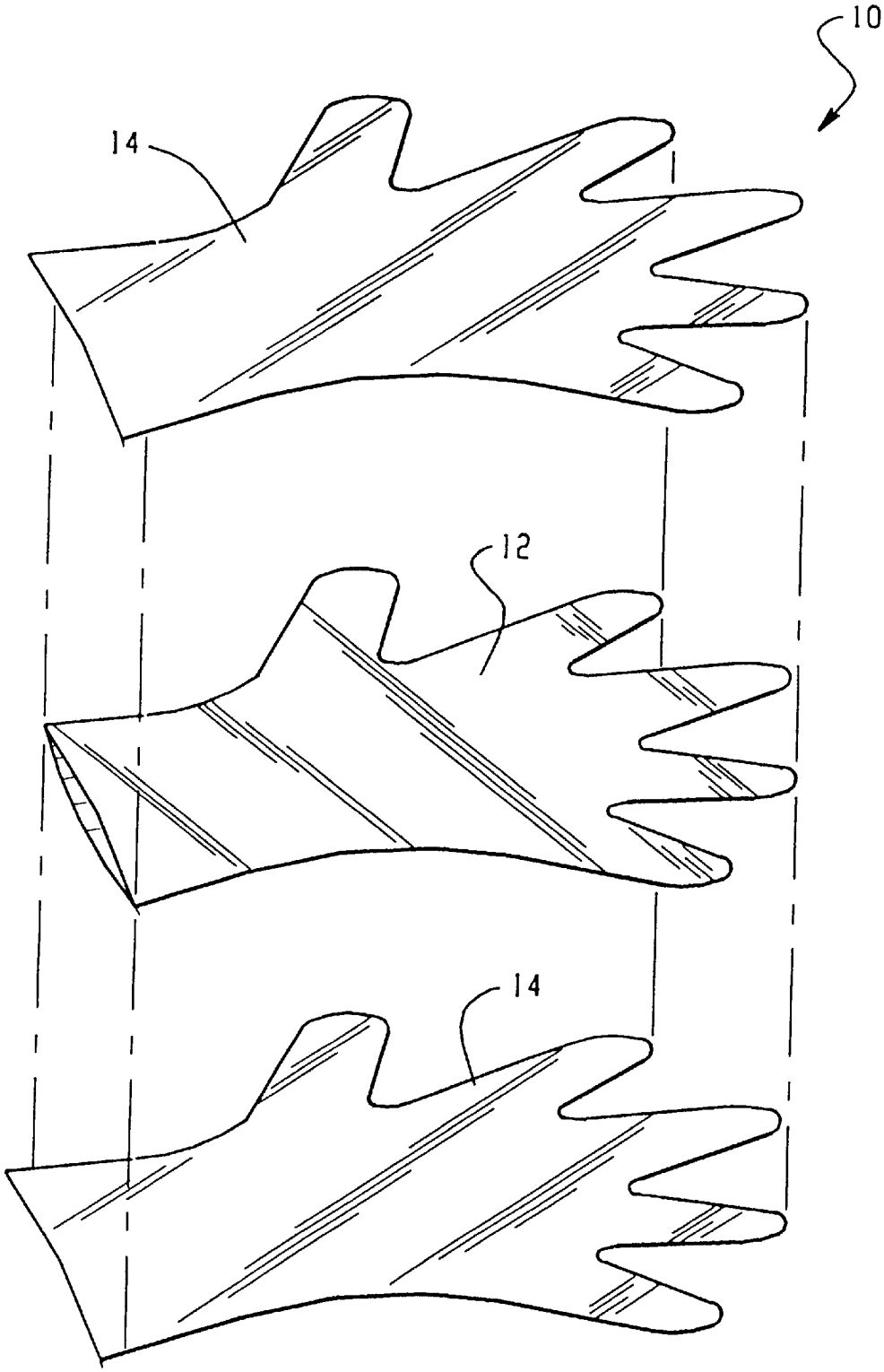
FIG. 3 is an exploded perspective view of the protective glove in accordance with the invention showing the separate outer layers and the inner glove.

Referring now to the drawings and to FIGS. 1 and 3 in particular, the illustrated protective glove is generally designated by reference numeral 10. The protective glove is a flexible covering for a hand having separate sections for each of the fingers and the thumb. Preferably, the protective glove extends part way up the arm. Preferably, the glove has a neuter design that can be worn by either a left hand or right hand. The protective glove according to the present invention comprises an inner glove 12 and removable outer glove layers 14 (as shown in FIG. 3).

Figure 2:
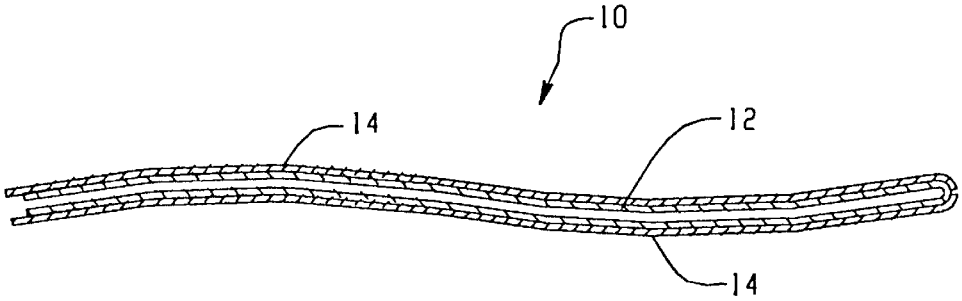
FIG. 2 is cross sectional view of the protective glove as seen from a plane taken along the lines 2—2 of FIG. 1.

As shown in FIG. 2, the material used for the inner glove is different from the material used for the outer layers. The removable outer layers 14 according to the present invention are made from materials having a lower melt temperature than the materials used for the inner glove 12. While not wanting to be bound by theory it is believed that by using materials with a lower melt temperature results in different tensile strengths and allows the outer layer material to be easily removed from the inner glove material. The outer layer material is frangibly fused to the inner glove material and normal wear of the protective glove will not cause the outer layer to separate from the inner glove. The surface of the inner glove, after removal of the outer layer, is substantially free from any contaminants. By removing the outer layers, the user can use the protective glove in a clean work environment without having the glove serve as a source for contamination.

The inner glove is made from a flexible material. Preferably, the inner glove is made from an elastomeric like material. More preferably, the inner glove is made from a material that allows water vapor permeation. The water permeation feature allows the user's hand to breathe by allowing release of moisture that may build up as a result of contact with skin. Suitable materials for the inner glove include polyurethane, polyacrylate, polyester, polytetrafluoroethylene, polyamide, blends or copolymers thereof and the like. Examples of suitable materials include thermoplastic polyurethanes or certain copolymers commercially available under the trademark HYSTREL by DuPont Company.

The removable outer glove layers 14 advantageously permits the user to wear the glove prior to use without fear of contaminating the inner glove. Once the outer layers are removed, the inner glove is substantially free from contaminants such as surface particulate and is ideally suited for use in clean rooms where contamination is problematic, such as for use in pharmaceutical, optical, and electronic manufacturing environments. The outer layers are mated to one side of the inner glove and completely cover each side of the inner glove. The outer layers are easily removed from the inner glove during use at a time most convenient to the user. The outer layer material has a lower melt temperature than the inner glove material. Suitable materials for the outer layers include polyolefin and the like. Examples of suitable polyolefins include polyethylene, polypropylene, EVA, EMA, blends and copolymers thereof Preferably, the outer material is made from polyethylene such as those commercially available from DuPont Company or Eastman Chemical Company. Other materials suitable for the outer layer will be apparent to one of ordinary skill in the art in view of this disclosure.

In one embodiment, a process of manufacturing the protective glove according to the present invention includes providing a hand shaped mold. The hand shaped mold is first dipped into a body of a liquid material for forming the inner glove. The liquid material is preferably a water vapor permeable material such as polyurethane or the like. The mold is then withdrawn from the material and dried using drying techniques generally known to those skilled in the art. The mold with the dried first layer is dipped into a second body of liquid material. The second body of liquid material is used to form the removable outer layer. The mold is withdrawn and the second layer is dried as described with respect to the first layer. The glove is removed from the mold and is now ready for use.

In another embodiment, the process of making the protective glove comprises the steps of cutting sheets of film into the shape of a hand according to standard practices known to those skilled in the art. Two of the cut shapes from the material used for the inner glove are aligned, stacked and a seam is formed about the periphery of the cut shape. The seam is formed by sealing such as by application of heat or any other means of sealing so that seams are formed. The wrist area is left unsealed. The cut shapes from the material used for the outer layer are aligned and mated to each side of the inner glove. The outer layers are then frangibly fused to each side of the inner glove by application of heat. Alternatively, the cut shapes could be arranged in a stack so that the outer layers and inner glove are sealed at the same time.

Figure 5:
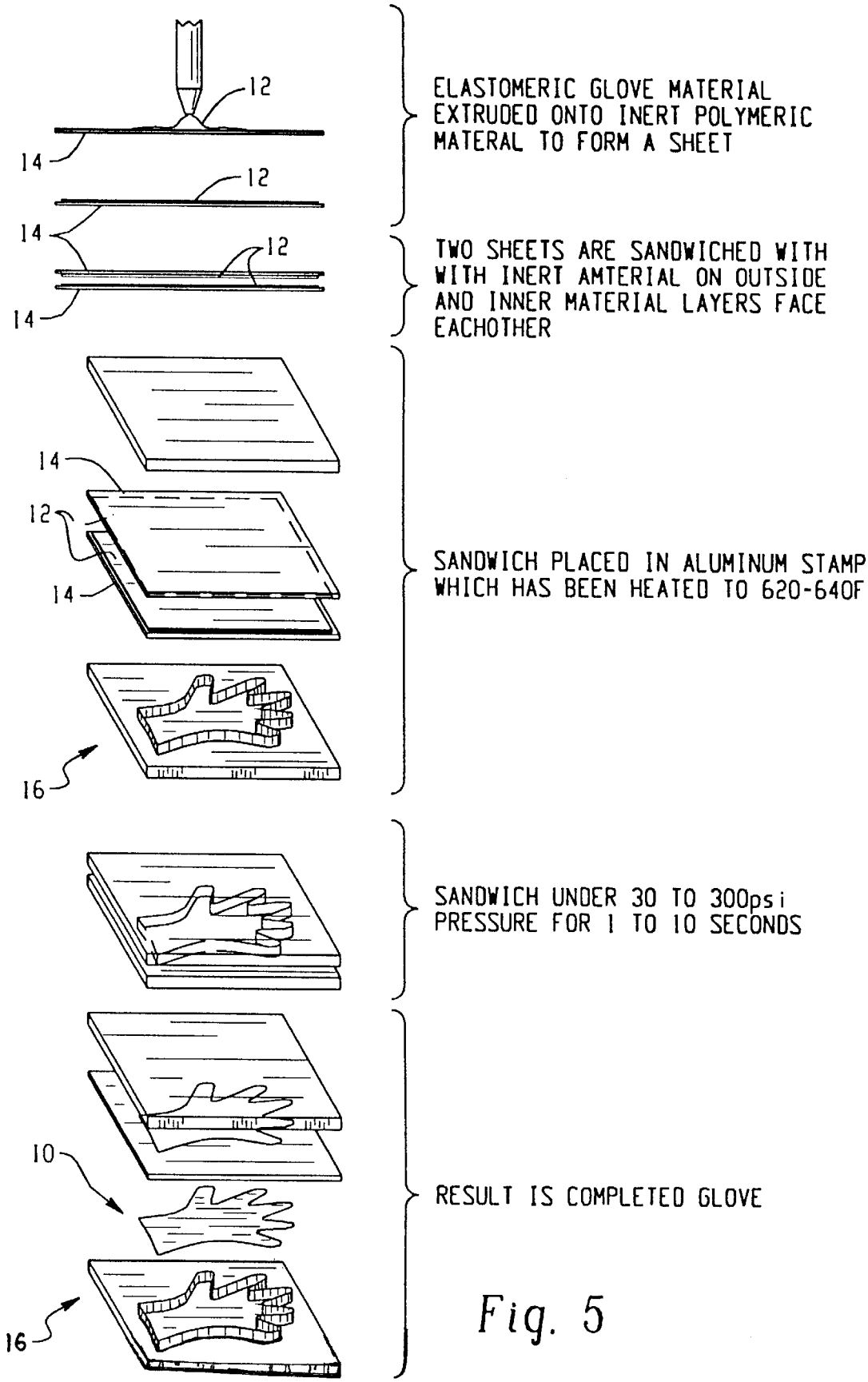
FIG. 5 is a schematic illustrating the sequence of steps for manufacturing the protective glove constructed in accordance with one embodiment of the invention.

In another embodiment, as shown in FIG. 5, the process of making the protective glove 10 includes extruding a layer of the elastomeric inner glove material 12 such as polyurethane onto an inert polymeric material 14 such as polyethylene. For example, molten polyurethane is extruded onto a polyethylene film using standard extrusion processes generally known to those skilled in the art. The molten polyurethane layer, as it is extruded onto the polyethylene film, is at a temperature below the melting temperature of the polyethylene. The resulting polyurethane layer so-formed and the polyethylene film are now frangibly fused together to form a single sheet. Two of these sheets are then placed on top of each other forming a sandwich 16 such that the polyurethane layers are in contact with each other forming the inner layers and the polyethylene films are not in contact with each other forming the outer layers. A hand shaped pattern is simultaneously cut out of this sandwich and the edges are sealed by applying heat and pressure forming the multilayer glove with removable outer layers. The hand shaped pattern is formed from an aluminum stamp that is hand shaped and heated to a temperature of about 620 to 640° F. The heated aluminum hand shaped stamp contacts the sandwich for about 1 to 10 seconds at a pressure from 30 to 300 psi to form the protective glove with removable outer layers. The polyurethane layers are sealed together forming an inner glove. The polyethylene layers form distinct removable outer layers that can be easily removed from either surface of the inner glove.

Optionally, the glove constructed according to either embodiment can be textured. Texturing a glove is well within the skill of one in the art and generally can be done by passing the films through a nip of an embossing roll and a resilient roll such as a so-called pulp roll, cotton roll or the like, at an elevated temperature. The resulting pattern may be checkered, striped, arabesque, wavered, grained, dashed, latticed or the like. Patterns comprising fine lines are least preferred since it is generally known that tearing strength is reduced.

Figure 4:
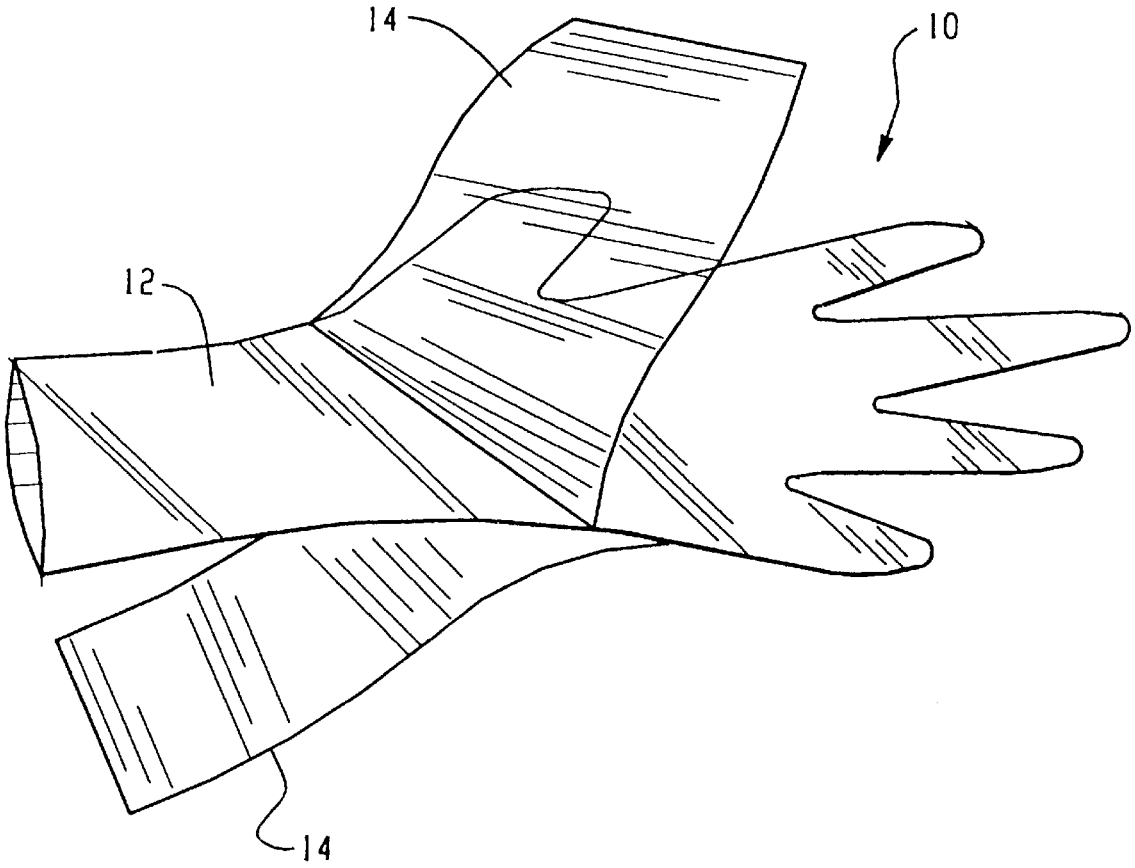
FIG. 4 is a perspective view of the protective glove showing an outer layer being removed from the inner glove.

A method of using the protective glove made according to the present invention includes the steps of inserting the hand into the inner glove by separating the inner glove layers and inserting the hand therein. As shown in FIG. 4, the removable outer layer 14 is peeled from a selected one of the inner glove topside and backside and is subsequently discarded. Then, the outer glove layer from the other one of the inner glove topside and backside can be peeled away and discarded, revealing the substantially contaminant free inner glove.

Table 1 shows the amount of surface particulate for given particle size ranges typically present on the inner glove after removing the outer layers of the inventive protective glove. Particle sizes were determined using standard methods known to those skilled in the art. The data shows very low particles levels are present on the inner glove once the outer layer is removed.

TABLE 1

| Particle size range (microns) | Particles/cm$^2$ |
|---|---|
| 5 to 10 | 1.00 |
| 10 to 20 | 1.30 |
| 20 to 50 | 0.12 |

The foregoing description of the preferred embodiments of the invention have been presented for purposes of illustration and description. It is not intended to be exhaustive or to limit the invention to the precise forms disclosed. For instance, other apparel such as booties or the like could be manufactured likewise with removable outer layers. Obvious modifications or variations are possible in light of the above teachings. The embodiments were chosen and described to provide the best illustration of the principles of the invention and its practical applications to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

What is claimed is:

1. A method of using a protective glove in a clean work environment wherein the protective glove includes an inner glove comprising a topside and a backside and separate removable outer glove layers having a lower melt temperature than said inner glove and overlying each side of said inner glove, said method of using the glove comprising the steps of putting on the protective glove; peeling the outer layer from a selected one of the inner glove topside and backside and peeling the outer glove layer from the other one of the inner glove topside and backside.

2. The glove according to claim 1 wherein said inner glove is comprised of a water vapor permeable material.

3. The glove according to claim 1 wherein said inner glove is a material selected from the group consisting of a polyurethane, polypropylene, polyacrylate, polyamide, polytetrafluoroethylene and blends or copolymers thereof.

4. The glove according to claim 1 wherein said outer glove layer is comprised of an elastomeric material.

5. The glove according to claim 1 wherein said outer glove layer is comprised of polyethylene.

6. A protective glove having removable outer layers for use in clean work environments comprising:

an inner glove having a topside and a backside;

at least one separate removable protective covering of a material having a lower melt temperature than said inner glove and a shape of a glove wherein said removable protective covering is frangibly fused to said inner glove.

7. The glove according to claim 6 wherein the removable protective coating is frangibly fused to a selected one of the topside and backside of the inner glove.

8. A protective glove having removable outer layers for use in clean work environments comprising:

an inner glove comprised of a water vapor permeable material and having a topside and a backside; and at least one separate removable protective covering having a shape of a glove wherein said removable protective covering is frangibly fused to said inner glove.

9. The glove according to claim 8 wherein said inner glove is a material selected from the group consisting of a polyurethane, polypropylene, polyacrylate, polyamide, polytetrafluoroethylene and blends or copolymers thereof.

10. The glove according to claim 9 wherein said outer glove layer is comprised of polyethylene.

11. A protective glove having removable outer layers for use in clean work environments comprising:

an inner glove having a topside and a backside; and at least one separate removable protective covering having a shape of a glove wherein said removable protective covering is frangibly fused to said glove and each side of said inner glove has the separate removable protective outer glove layer.

12. A protective glove having removable outer layers for use in clean work environments comprising:

an inner glove having a topside and a backside;

at least one separate removable protective covering having a shape of a glove wherein said removable protective covering is frangibly fused to said inner glove; and said inner glove has a different tensile strength than said protective covering outer layer.

* * * * *